US012134958B2

(12) United States Patent
Dyess et al.

(10) Patent No.: US 12,134,958 B2
(45) Date of Patent: Nov. 5, 2024

(54) PERFORATING PANEL UNIT AND METHOD

(71) Applicant: Hunting Titan, Inc., Pampa, TX (US)

(72) Inventors: Adam Dyess, Houston, TX (US); Timothy Vriend, Houston, TX (US); Sridhar Rajaram, Houston, TX (US); David Dobsky, Houston, TX (US); Antonie Gucciardi, Houston, TX (US)

(73) Assignee: Hunting Titan, Inc., Pampa, TX (US)

( * ) Notice: Subject to any disclaimer, the term of this patent is extended or adjusted under 35 U.S.C. 154(b) by 0 days.

(21) Appl. No.: 18/089,051

(22) Filed: Dec. 27, 2022

(65) Prior Publication Data

US 2023/0136896 A1 May 4, 2023

Related U.S. Application Data

(63) Continuation of application No. 17/904,224, filed as application No. PCT/US2021/018073 on Feb. 14, 2021.

(60) Provisional application No. 63/134,281, filed on Jan. 6, 2021, provisional application No. 62/977,115, filed on Feb. 14, 2020.

(51) Int. Cl.

| | |
|---|---|
| ***E21B 43/119*** | (2006.01) |
| ***E21B 23/06*** | (2006.01) |
| ***E21B 47/04*** | (2012.01) |
| ***E21B 47/09*** | (2012.01) |

(52) U.S. Cl.
CPC ..... *E21B 43/119* (2013.01); *E21B 23/06* (2013.01); *E21B 47/04* (2013.01); *E21B 47/09* (2013.01)

(58) Field of Classification Search
CPC ..... E21B 43/119; E21B 23/06; E21B 23/08; E21B 23/14; E21B 47/04; E21B 47/09
See application file for complete search history.

(56) References Cited

U.S. PATENT DOCUMENTS

| | | | | |
|---|---|---|---|---|
| 9,617,814 | B2 | 4/2017 | Seals et al. | |
| 2003/0010495 | A1 | 1/2003 | Mendez et al. | |
| 2006/0278394 | A1 | 12/2006 | Stover | |
| 2013/0138254 | A1* | 5/2013 | Seals | E21B 23/08 175/2 |
| 2015/0096752 | A1 | 4/2015 | Burgos et al. | |
| 2015/0330172 | A1* | 11/2015 | Allmaras | E21B 23/14 166/250.01 |
| 2018/0135398 | A1* | 5/2018 | Entchev | E21B 44/005 |
| 2018/0274346 | A1* | 9/2018 | Modeland | E21B 43/26 |
| 2019/0203575 | A1* | 7/2019 | Schlosser | E21B 19/008 |
| 2020/0131428 | A1* | 4/2020 | Dawson | C09K 8/70 |
| 2020/0224508 | A1* | 7/2020 | Chapman | E21B 47/008 |
| 2020/0270979 | A1* | 8/2020 | Hradecky | G05B 15/02 |

OTHER PUBLICATIONS

International Preliminary Report on Patentability, Aug. 11, 2022, 8 pages.

* cited by examiner

*Primary Examiner* — Christopher J Sebesta

(57) ABSTRACT

A method and apparatus for controlling a perforating tool string using a perforating unit with a control board and shooting power supply.

19 Claims, 12 Drawing Sheets

PERFORATING PANEL UNIT AND METHOD

RELATED APPLICATIONS

This application is a continuation of U.S. application Ser. No. 17/904,224, Filed Aug. 14, 2022, which is a 371 U.S. National phase application of PCT/US21/18073, filed Feb. 14, 2021, which claims priority to U.S. Provisional Application No. 63/134,281, filed Jan. 6, 2021 and U.S. Provisional Application No. 62/977,115, filed Feb. 14, 2020.

BACKGROUND OF THE INVENTION

Current methods of perforating a wellbore, particularly pump down perforating in a horizontal well, combine multiple complex operations involving multiple services and surface equipment which are operated independently by various human users. A wireline unit is required to convey the perforating tool string downhole via electric cable and is controlled by a human via a winch control. The downhole perforating tool string is comprised of a cable head for attaching to the wireline, a depth correlation tool such as a casing collar locator (CCL) and/or gamma ray (GR) detector, an optional orientation sensor to signal the position of the perforating guns within the well-bore, an optional tension tool to provide downhole tool tension, multiple perforating guns, and a setting tool for setting plugs. For horizontal wells, a manned pumping unit is required to pump fluids to push the perforating tools string through the lateral portion of the wellbore to the final desired measured depth. The shooting panel, typically operated by an individual inside the wireline unit, is required to communicate and selectively apply power to each perforating gun in the downhole perforating tool string. The acquisition system, typically operated by an individual inside the wireline unit, is required to collect and process the wireline speed, surface tension and depth data from the winch system, and process the downhole tension, depth correlation data signals such as casing collar locator and/or gamma ray detector, and tool orientation data from the downhole tool in order to visualize and log the operation. There is a need to combine one or more of the following processes—pumping down the perforating tool string, conveyance winch control, shooting power supply and perforating data acquisition into an automated and singularly controlled entity referred to as a perforating unit. A perforating unit as described herein reduces in human error that occurs through manual operation of the wireline winch, pumping unit, acquisition system and/or shooting panel. Related human error has and could result in monetary loss due to downtime, damages and/or well abandonment. Related human error has and could result in damage to equipment, environment and personnel including loss of life. The perforating unit is a single unit or system of multiple compatible units aimed to automate and control one or more of the following systems and processes: surface pumping unit during pump down operations, winch system during pump down and perforating operations, data acquisition system during pump down and perforating operations and the Shooting Power Supply during perforating operations.

BRIEF SUMMARY OF THE INVENTION

An example embodiment may include a control system for controlling an initiator in a perforating gun string comprising a perforating unit further comprising a software driven power supply, a control board coupled to the power supply, wherein the power supply is programmed to automatically output a specified amount of voltage/current over a specified period within a specified depth window.

A variation of the example embodiment may include a data acquisition system. It may include a winch controller. It may include the electronic switch software being programmed with user inputs for the number of downhole switches, initiating device, shot depth, each initiating device depth correlation offset, and automatically calculating stop depth and ideal winch speed for retrieval during the automated perforating process. It may include the output voltage and duration being pre-programmed based on a selection of common initiator types used in downhole completion tools. It may include the output voltage and duration being based on firing a detonator in a perforating gun. It may include the output voltage and duration being based on firing an igniter in a plug setting tool. It may include the perforating panel automatically communicating with one or more downhole addressable switches, determining depth matches shot depth, and applying appropriate power at correct shot depth. It may include the data acquisition system of the perforating unit acquires, processes and logs data representing line speed from the conveyance winch system, depth data from the conveyance winch system, surface tension from the conveyance winch system, pump rate from a surface pump unit, downhole tension from downhole tool sensor, casing collar locator data from downhole tool sensor, gamma ray data from downhole tool sensor, and tool orientation from the downhole tool orientation sensor. It may include the winch controller automatically responding to data acquired and processed by the data acquisition system of the perforating unit. It may include the perforating unit controlling the conveyance unit's winch speed during the pump down process. It may include the perforating unit controlling the pumping rate of a surface pumping unit used to flow fluids downhole under pressure in order to push the downhole wireline tool string laterally into the horizontal wellbore until desired measure depth is reached. It may include a pump controller. It may include a winch controller monitoring the depth, line speed, pump rate and tool tension data from the data acquisition system of the perforating unit to automatically adjust line speed of the winch system to maintain optimal tool tension and ideal pump rate. It may include the optimal tool tension being calculated by the data acquisition system of the perforating unit based on pre pump down operation user input, downhole tool pressure rating, min and max line speed, min and max surface tension and cable head weak point rating (max tool string tension). It may include the ideal pump rate being input into the data acquisition system at incremental depths based on known well deviation survey before the pump down operation into. It may include the optimal tool tension and ideal pump rate being automatically adjusted by perforating unit according to depth as the tool string is pumped into the horizontal well.

An example embodiment may include a method for detonating a downhole tool comprising lowering the tool into a wellbore a first predetermined distance, scanning the gun string, inputting job parameters into perforating unit, descending the tool to a second predetermined wellbore depth, deactivating the pump at the second predetermined wellbore depth, stopping the tool at the second predetermined wellbore depth, ascending the tool to a first predetermined shot depth, calculating the optimal winch speed based on shot distances and required firing time, firing the tool at the first predetermined shot depth, wherein the perforating unit sends a command to a shooting power supply to initiate, determining if the firing at the first predetermined shot depth was successful, and determining if all shots have been fired.

A variation of the example embodiment may include descending the tool string downhole via a winch controller. It may include determining if the tool is ready for descent. It may include acquiring data using downhole tool data sources. The downhole tool data including tool tension, data from a casing collar locator, data from a gamma ray tool, or data includes data from the orientation sensor. It may include acquiring surface data, including tool depth or surface tension. It may include calculating line speed using by the data acquisition based on surface winch data sources. It may include comprising acquiring pump rate data. It may include correlating data to determine the location of the tool string and its downhole velocity. It may include adjusting the winch speed to match desired speed. It may include descending the tool to a desired deviation. It may include managing the pump via a pump controller to achieve a desired tool tension. It may include adjusting the pump via a pump controller and the winch via a winch controller to achieve a desired tool tension. The second predetermined depth may be the bottom hole depth. The pump controller may deactivate the pump at the second predetermined depth. Stopping the tool at the second predetermined depth may be performed by the winch controller. It may include selecting for fully automatic or semi-automatic perforating method. It may include setting a plug. It may include detecting the firing a deactivating the shooting power supply. It may include preventing a short circuit after firing the shot at the tool at the first predetermined shot depth.

DETAILED DESCRIPTION OF THE INVENTION

Figure 1:
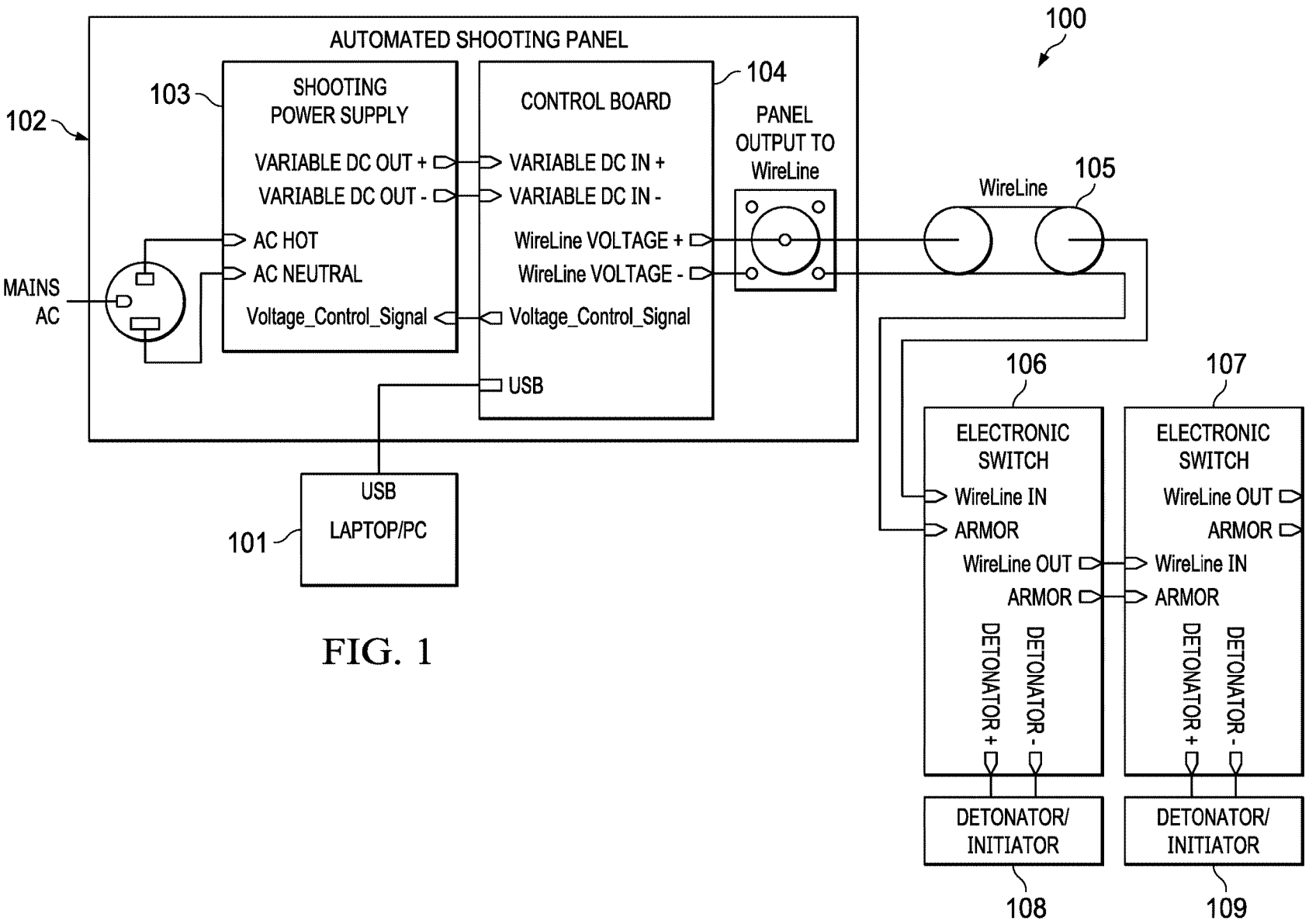
FIG. 1 shows a diagram representing a downhole perforating gun tool string on a wireline electrically connected to an perforating panel.

In the following description, certain terms have been used for brevity, clarity, and examples. No unnecessary limitations are to be implied therefrom and such terms are used for descriptive purposes only and are intended to be broadly construed. The different apparatus, systems and method steps described herein may be used alone or in combination with other apparatus, systems and method steps. It is to be expected that various equivalents, alternatives, and modifications are possible within the scope of the appended claims.

Terms such as booster may include a small metal tube containing secondary high explosives that are crimped onto the end of detonating cord. The explosive component is designed to provide reliable detonation transfer between perforating guns or other explosive devices, and often serves as an auxiliary explosive charge to ensure detonation.

Detonating cord is a cord containing high-explosive material sheathed in a flexible outer case, which is used to connect the detonator to the main high explosive, such as a shaped charge. This provides an extremely rapid initiation sequence that can be used to fire several shaped charges simultaneously.

A detonator or initiation device may include a device containing primary high-explosive material that is used to initiate an explosive sequence, including one or more shaped charges. Two common types may include electrical detonators and percussion detonators. Detonators may be referred to as initiators. Electrical detonators have a fuse material that burns when high voltage is applied to initiate the primary high explosive. Percussion detonators contain abrasive grit and primary high explosive in a sealed container that is activated by a firing pin. The impact of the firing pin is sufficient to initiate the ballistic sequence that is then transmitted to the detonating cord.

Conventional perforating in vertical wells or unconventional perforating in horizontal wells utilizing any conveyance method which the downhole tool is tethered to the winch system of the proposed invention via electrical line. While perforating is the main application, the same invention and methods can be applied to any well operation in which a downhole device is to be initiated at a determined depth by sending power down an electrical cable such as wireline. Examples other than perforating include: setting a plug, initiating a cutter to cut casing, initiating a severing tool or back off tool to free stuck pipe, initiating a detonator in bailer to dump cement, delivering stimulation treatment to perforation zone(s), or initiating any other ballistic device downhole.

"Shooting Panels" (aka "Shooting Power Supply" and "Perforating Panel" and "Perforating Unit") are surface electronic power supply units that connect to a downhole conveyance, such as wireline, and supply power to downhole completion tools, mainly perforating systems. The electrical path from shooting panel at surface to initiator/detonator in the perforating gun is: VAC Wall socket— VDC shooting panel—wireline collector ring—wireline— cable head contact—Casing Collar Locator—Electronic Switch in Perforating Gun—detonator in Perforating Gun or igniter in Plug Setting Tool. Multiple perforating guns are connected in series below CCL. Each perforating gun contains electrical contacts or wires to connect the electric path above to an electronic switch and initiator (detonator). Once the detonator is initiated via applied power, the blast transfers to detonating cord which initiates the attached shaped charges in the perforating gun.

The perforating process requires several steps for successful on depth perforating utilizing select-fire electronic switches in perforating guns. First the user must ensure the perforator is at the correct downhole position as the wireline is retrieved from bottom hole depth via a winch and depth tracking system which is independent of the shooting panel. Simultaneous to being on depth, the user must send electronic commands via electronic switch software to the downhole switch to address, arm and ready to fire the gun. Once on depth, or approaching depth if shooting while moving up, a two hand process must be implemented when firing each gun: (1) typically holding a spring loaded trigger or pushing and holding a spring loaded button (2) Pushing and holding a separate spring loaded button or turning a knob from hard left/stop (zero) clockwise (increased voltage). The above actions must be taken in a relatively short window of time (10-30 seconds) and can be complicated further if shooting while moving up hole quickly.

An example embodiment of a perforating unit will allow automation or semi automation of the shooting power supply and electronic switch software during the perforating process once started downhole. The perforating processes done by the user that can be automated include: correlating depth acquisition to the electronic switch software and power supply panel, software input to check-arm-enable the electronic switch and applying the necessary voltage for the adequate amount of time to fire the initiator. Prior to deployment or during the trip downhole at a depth below 200 feet, the user can power the perforating unit and select "Auto Mode" in the perforating unit then setup the automated process by entering the number of electronic switches, each gun shot depth, depth correlation off set and stop depth. When the perforating tool string is at the bottom hole depth the user begins retrieving the tool string up hole at the winch speed calculated by the perforating unit. The user will start the perforating process with a simple two-handed operation such as holding keyboard button while pressing a spring loaded button on the perforating unit. This starts the automation sequence. As the downhole tool string approaches each shot depth, the perforating unit will autonomously address the switch for each gun and apply power to fire each gun in the pre-programmed sequence at the exact shot depth input during setup. The user does not have to "do" anything during the perforating process once started. The user can focus on winch speed and other non-perforating operations. As an alternative method, the user must take two actions within each shot depth window (+/−x feet within each shot depth) in order for the power supply to automatically output shooting power. The two-handed operation could be holding keyboard button while pressing a spring loaded button on the perforating unit. The perforating unit will also have standard manual mode capabilities. Should any issues arise, the system will alert the user to stop and revert to manual mode.

An example embodiment is disclosed in FIG. 1 showing the perforating unit 100. The perforating unit 100 includes an automated shooting panel 102 powered by AC mains. The AC mains power the shooting power supply 103 which is coupled to the control board 104. Control board 104 is coupled to a computer 101, either via a USB connection or a wireless connection. Control board 104 is coupled to a panel output, which is coupled to the wireline 105. The wireline 105 is connected to a downhole tool that includes one or more electric switches 106 and 107, by example, which are each connected to a detonator/initiator 108 and 109, respectively. The perforating unit 100 can detect the firing of the detonator/initiator 108 and/or 109 and automatically disconnect the firing voltage supplied by the shooting power supply 103, thus preventing a short circuit caused by wellbore fluids entering the downhole tool after detonation. The mitigation of a short circuit preserves the wireline 105 as well as other electronics coupled to the wireline.

Figure 2:
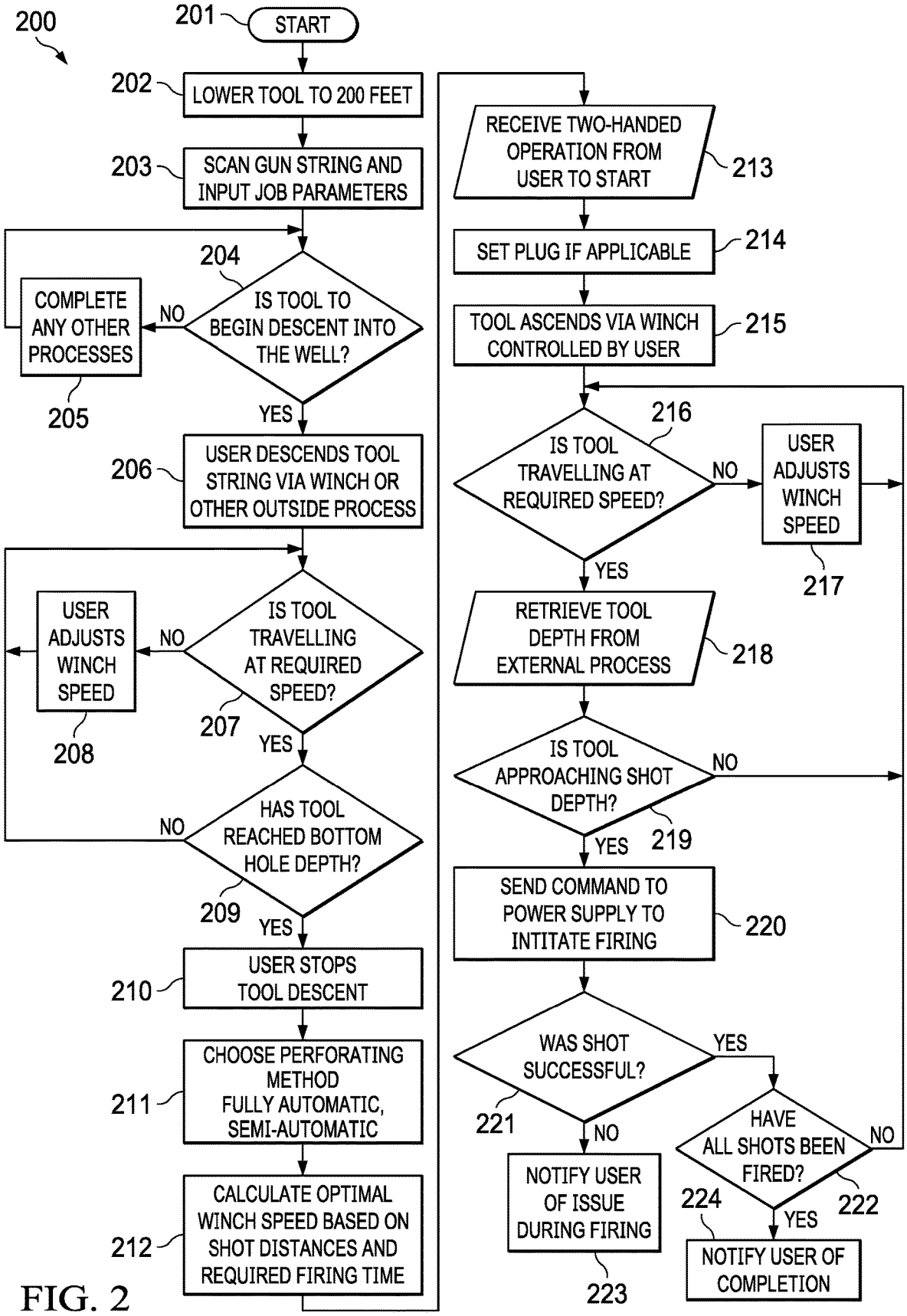
FIG. 2 shows a flow diagram of the operation of a perforating panel interfacing with a downhole perforating gun string.

An example embodiment is disclosed in FIG. 2 showing the flowchart of the perforating unit 200 which includes an automated shooting panel. The program starts 201 and lowers the tool to 200 feet 202. The perforating unit 200 then scans the gun string and inputs the job parameters 203. The perforating unit 200 then decides if the tool is to begin the descent into the well 204. If the tool is not ready for descent, then the user will complete any other processes 205 and then decide if the tool is to begin the descent into the well 204. If the tool is ready to descend then the user descends the tool string via a winch 206 or other option. The speed of descent is queried 207 and if the descent is not at the required speed then then user adjusts the winch speed 208. If the tool is descending at the required speed it will continue until it has reach the bottom hole depth 209. When the tool reaches the desired depth, the user stops the tool descent 210. The user then selects the perforating method is either fully automatic or semi-automatic, 211. The program calculated the optimal winch speed based on shot distances and required firing time 212. The perforating unit 200 then receives the two-handed operation from the user to start 213. A plug is set if applicable 214. The tool ascends via winch controlled by user 215. The tool speed is evaluated 216 and adjusted as necessary 217. The perforating unit 200 retrieves the tool depth from an external process 218. When the program determines that the tool is approaching the shot depth 219 it sends a command to the power supply to initiate firing 220. The perforating unit 200 then determines whether the shot was successful 221. If it was not successful then the user is notified of any issues 223. If it was successful then the program determines if all shots have been fired 222. If all shots have been fired then the program notifies the user of completion 224. If all shots have not been fired then the program will revert to the querying tool speed and depth to fire the next shots.

An example embodiment of a perforating unit can automate and control both the shooting power supply and data acquisition during the perforating process. A separate independent data acquisition system would not be required for the operation. The data acquisition system of the perforating unit acquires, processes, interprets and logs one or more of the following data sets: depth data from the winch unit, line speed data from the winch unit, surface tension data from the winch unit, tension data from sensors on the downhole tool string, orientation sensor data from the downhole tool string, and depth correlation data from sensors in the downhole tool string such as Casing Collar Locator (CCL) or Gamma Ray (GR) detectors. One or more of the processed data sets is monitored by the perforating unit such that the shooting power supply and electronic switch software automatically responds without any user input once Auto mode is activated on the perforating unit.

The perforating processes done by the user that can be automated include: correlating depth acquisition to the electronic switch software and power supply panel, software input to check-arm-enable the electronic switch and applying the necessary voltage for the adequate amount of time to fire the initiator. Prior to deployment or during the trip downhole at a depth below 200 feet, the user can power the perforating unit and select "Auto Mode" in the perforating unit then setup the automated process by entering the number of electronic switches, each gun shot depth, depth correlation off set and Stop depth. When the perforating tool string is at bottom hole depth the user begins retrieving the tool string up hole at the winch speed calculated by the perforating unit. The user will start the perforating system with a simple two-handed operation such as holding keyboard button while pressing a spring loaded button on the perforating unit. This starts the automation sequence. As the downhole tool string approaches each shot depth, the perforating unit will autonomously address the switch for each gun and apply power to fire each gun in the pre-programmed sequence at the exact shot depth input during setup. The user does not have to "do" anything during the perforating process once started. The user can focus on winch speed and other non-perforating operations. As an alternative method, the user must take two actions within each shot depth window (+/−x feet within each shot depth) in order for the power supply to automatically output shooting power. The two-handed operation could be holding keyboard button while pressing a spring loaded button on the perforating unit. The perforating unit will also have standard manual mode capabilities. Should any issues arise, the system will alert the user to stop and revert to manual mode.

Figure 3:
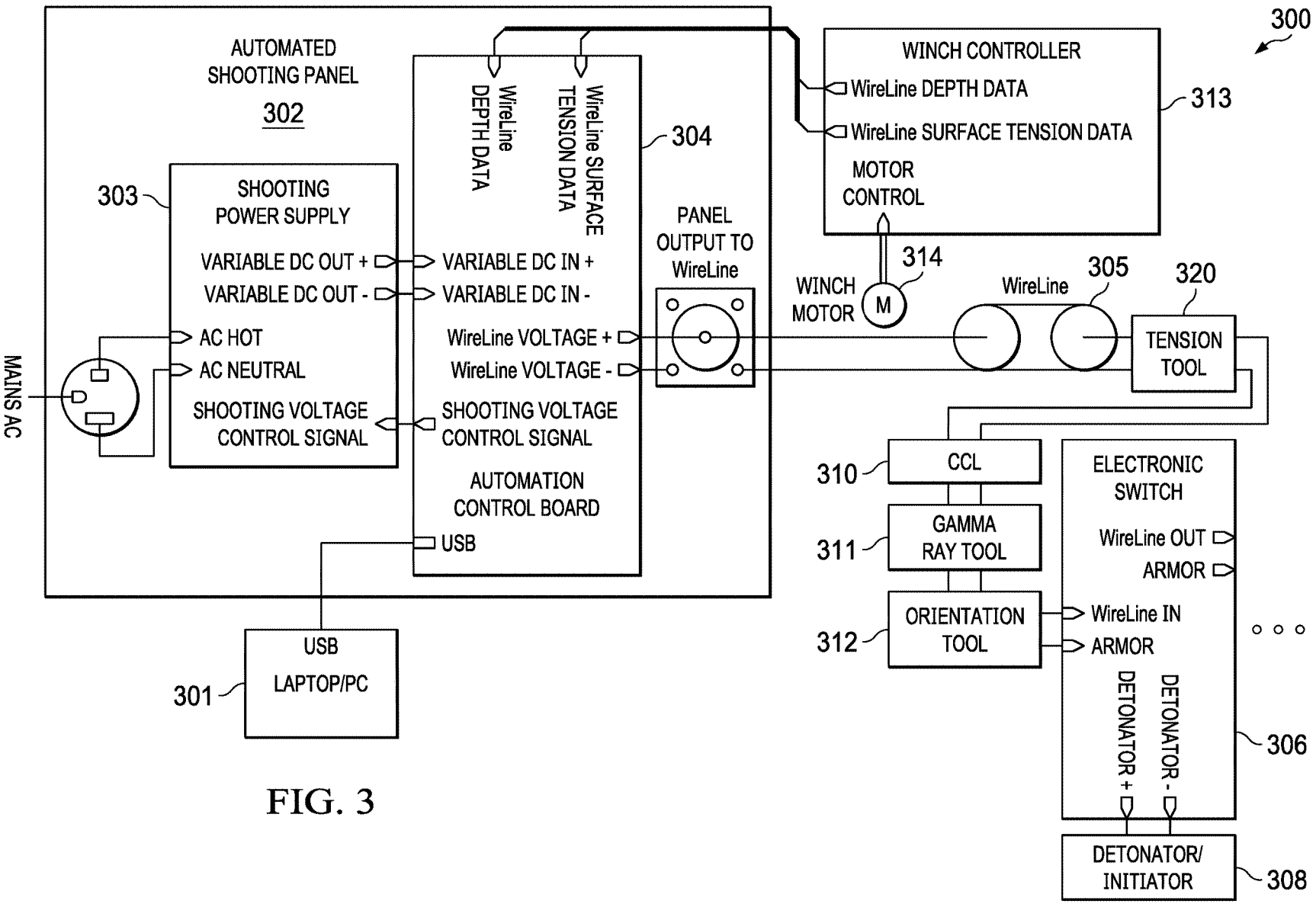
FIG. 3 shows a diagram representing a downhole perforating gun tool string with a casing collar locator, gamma ray tool, and orientation tool on a wireline electrically connected to a perforating panel and an data acquistion system. The winch controller of FIG. 3 is a separate, but compatible entity which may or may not be automatically controlled by the perforating panel.

An example embodiment is disclosed in FIG. 3 showing the perforating unit 300 having a perforating panel and data acquisition system. The perforating unit 300 includes an automated shooting panel 302 powered by AC mains. The AC mains power the shooting power supply 303 which is coupled to the control board 304 which includes data acquisition. Control board 304 is coupled to a computer 301, either via a USB connection or a wireless connection. Control board 304 is coupled to a panel output, which is coupled to the wireline 305. The wireline 305 is connected to a downhole tool that can include one or more of a downhole tension tool 320, casing collar locator (CCL) 310, a gamma ray tool 311, an orientation tool 312, and at least one electronic switch 306 which is connected to at least one detonator/initiator 308. The control board 304 acquires one or more of the wireline depth and wireline surface tension data from the winch controller 313 which is controlled by a separate winch motor 314. Wireline speed is calculated by the Control board 304 data acquisition system based on data from the winch controller 313. The winch controller 313 is manually adjusted by the user to control the winch motor 314. The perforating unit 300 can detect the firing of the detonator/initiator 308 and automatically disconnect the firing voltage supplied by the shooting power supply 303, thus preventing a short circuit caused by wellbore fluids entering the downhole tool after detonation. The mitigation of a short circuit preserves the wireline 305 as well as other electronics coupled to the wireline.

Figure 4A:
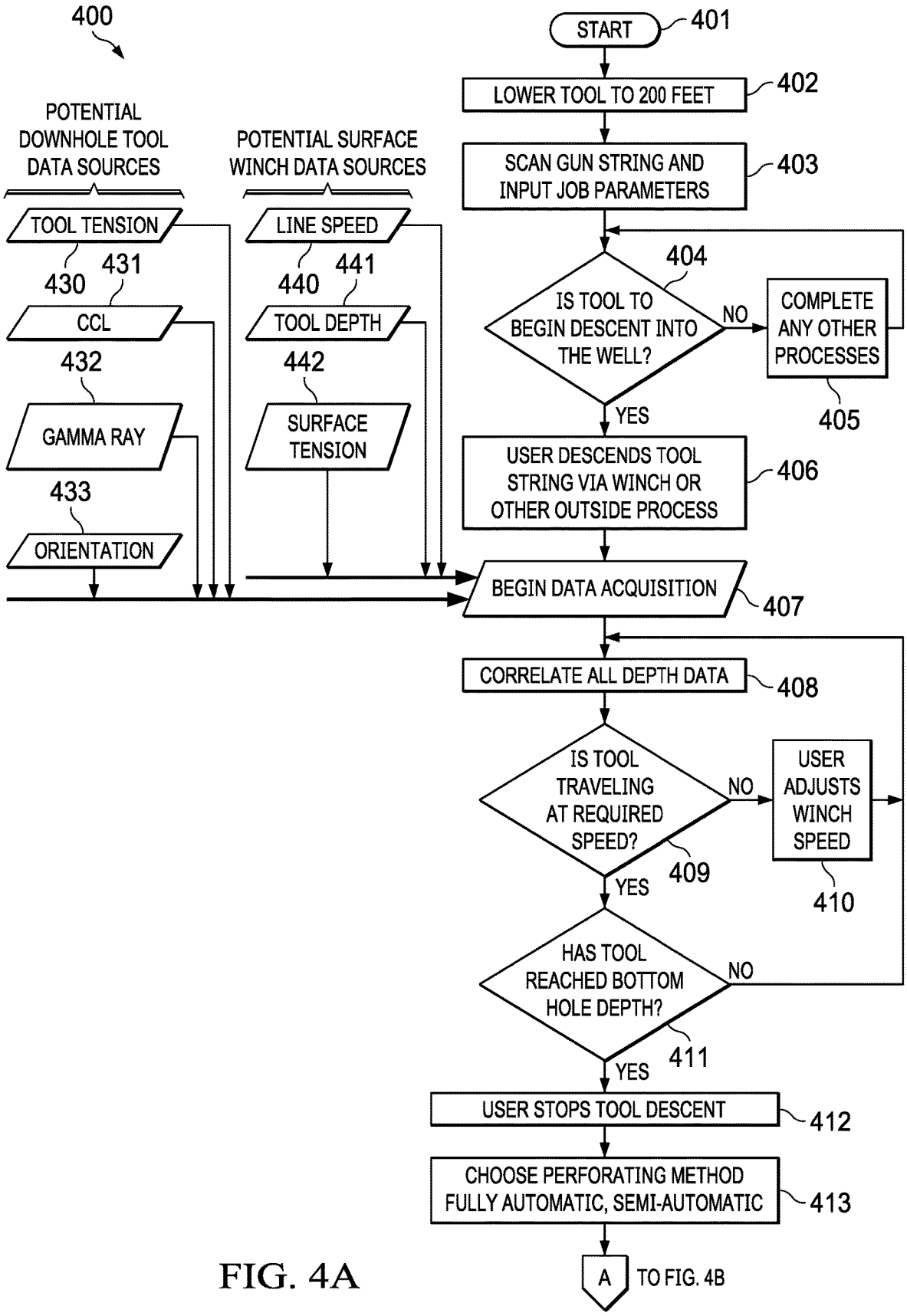
FIGS. 4A and 4B show a flow diagram of the operation of a perforating unit, having a perforating panel and data acquisition system, interfacing with a downhole perforating gun string.

An example embodiment is disclosed in FIG. 4A showing the flowchart of the perforating unit 400 with a perforating panel and data acquisition system. The program starts 401 and lowers the tool to 200 feet 402. The perforating unit 400 scans the gun string and the user inputs the job parameters 403. The user then decides if the tool is to begin the descent into the well 404. If the tool is not ready for descent, then the user will complete any other processes 405 and then decide if the tool is to begin the descent into the well 404. If the tool is ready to descend then the user descends the tool string via a winch 406 or other option.

The perforating unit 400 will acquire data 407 using downhole tool data sources such as tool tension 430, the casing collar locator 431, the gamma ray tool 432, and the orientation sensor 433. The perforating unit 400 will acquire data 407 using surface winch data including line speed 440, tool depth 441, and surface tension 442. All depth data is correlated 408.

The speed of descent is queried 409 and if the descent is not at the required speed then then user adjusts the winch speed 410. If the tool is descending at the required speed it will continue until it reaches the bottom hole depth 411. When the tool reaches the desired depth, the user stops the tool descent 412. The user then selects the perforating method that is either fully automatic or semi-automatic, 413.

Figure 4B:
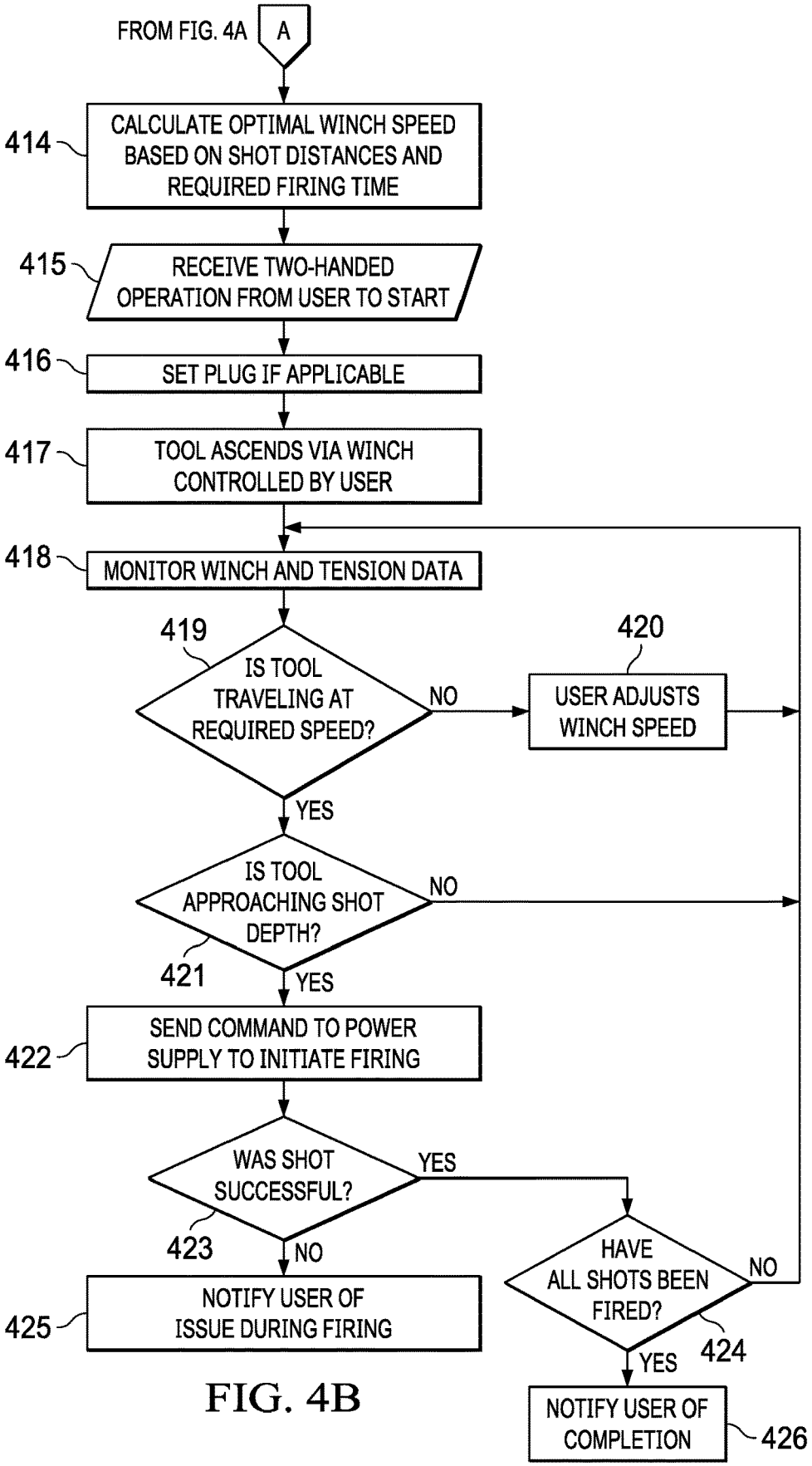

The program depiction continues in FIG. 4B. The program calculates the optimal winch speed based on shot distances and required firing time 414 as the user retrieves the tool string via the winch control. The perforating unit 400 then receives the two-handed operation from the user to start 415 shooting operations. A plug is set if applicable 416. The tool ascends via winch controlled by user 417. The program monitors the winch and tension data 418. The tool speed is evaluated 419 and adjusted as necessary 420. The perforating unit 400 determines whether the tool is approaching the shot depth 421. When the program determines that the tool is approaching the shot depth 421 it sends a command to the power supply to initiate firing 422. The perforating unit 400 then determines whether the shot was successful 423. If it was not successful, then the user is notified of any issues 425. If it was successful, then the program determines if all shots have been fired 424. If all shots have been fired, then the program notifies the user of completion 426. If all shots have not been fired, then the program will revert to querying tool speed and depth to fire the next shots.

An example embodiment of the perforating unit can automate and control the shooting power supply, data acquisition system and winch controller during tool deployment into well, tool retrieval out of well, and perforating processes. The data acquisition system of the perforating unit acquires, processes, interprets and logs one or more of the following data sets: Depth data from the winch unit, line speed data from the winch unit, surface tension data from the winch unit, tension data from sensors on the downhole tool string, orientation sensor data from the downhole tool string, and depth correlation data from sensors in the downhole tool string such as Casing Collar Locator (CCL) or Gamma Ray (GR) detectors. One or more of the data sets is monitored by the perforating unit such that one or more of the winch controller, shooting power supply and electronic switch software, automatically responds without any user input once automatic mode is activated on the perforating unit. The processes done by the user that can be automated include: deployment and retrieval of the perforating tool string via the winch at depths below 200 ft., correlating depth acquisition to the electronic switch software and power supply panel, software input to check-arm-enable the electronic switch and applying the necessary voltage for the adequate amount of time to fire the initiator. The perforating tool string is deployed into the well bore below a depth of 200 feet before the perforating unit is powered on. Prior to descent into the well or during the trip downhole below a depth of 200 feet, the user can select "Auto Mode" in the perforating unit then setup the automated process by entering the total depth, min and max line speed, min and max surface tension, number of electronic switches, each gun shot depth, depth correlation off set and each Stop depth.

During descent into the well bore, which does not require surface pumping to assist the tools sting to total depth, the data acquisition portion of the perforating unit acquires and interprets data used for depth correlation. Line Depth, line speed and surface tension are gathered from the winch unit and displayed on the main perforating unit graphical user interface (GUI). Depth correlation data is acquired from sensors in the downhole tool string such as Casing Collar Locator (CCL) or Gamma Ray (GR) detectors then processed and displayed on the perforating unit GUI. The perforating unit utilizes the data from the data acquisition system to control winch speed during descent into well and automatically stops once total depth is reached according to pre job setup. At any point in time, the user can exit "Auto Mode" to manually control the winch system.

For both vertical and horizontal well completions, the perforating process begins during ascent out of the well. Once at total depth the perforating unit winch control automatically retrieves the tool string up hole at the winch speed calculated by the perforating unit based on user inputs during job setup. The user will start the perforating system with a simple two-handed operation such as holding keyboard button while pressing a spring loaded button on the perforating unit. This starts the shooting power supply automation sequence. As the downhole tool string autonomously approaches each shot depth, the perforating unit will autonomously address the switch for each gun, arm and apply power to fire each gun in the pre-programmed sequence at the exact shot depth input during setup. The user does not have to "do" anything during the perforating process once started. As an alternative method, the user must take two actions within each shot depth window (+/−x feet within each shot depth) in order for the power supply to automatically output shooting power. The two-handed operation could be holding keyboard button while pressing a spring loaded button on the perforating unit. The perforating unit will also have standard manual mode capabilities. Should any issues arise, the system will alert the user to stop and revert to manual mode.

The perforating unit will monitor winch speed and surface and/or downhole tension to safely return the tool string to surface and stop at 200 feet. The perforating unit will revert to manual mode where the winch must be manually controlled until back at surface.

Figure 5:
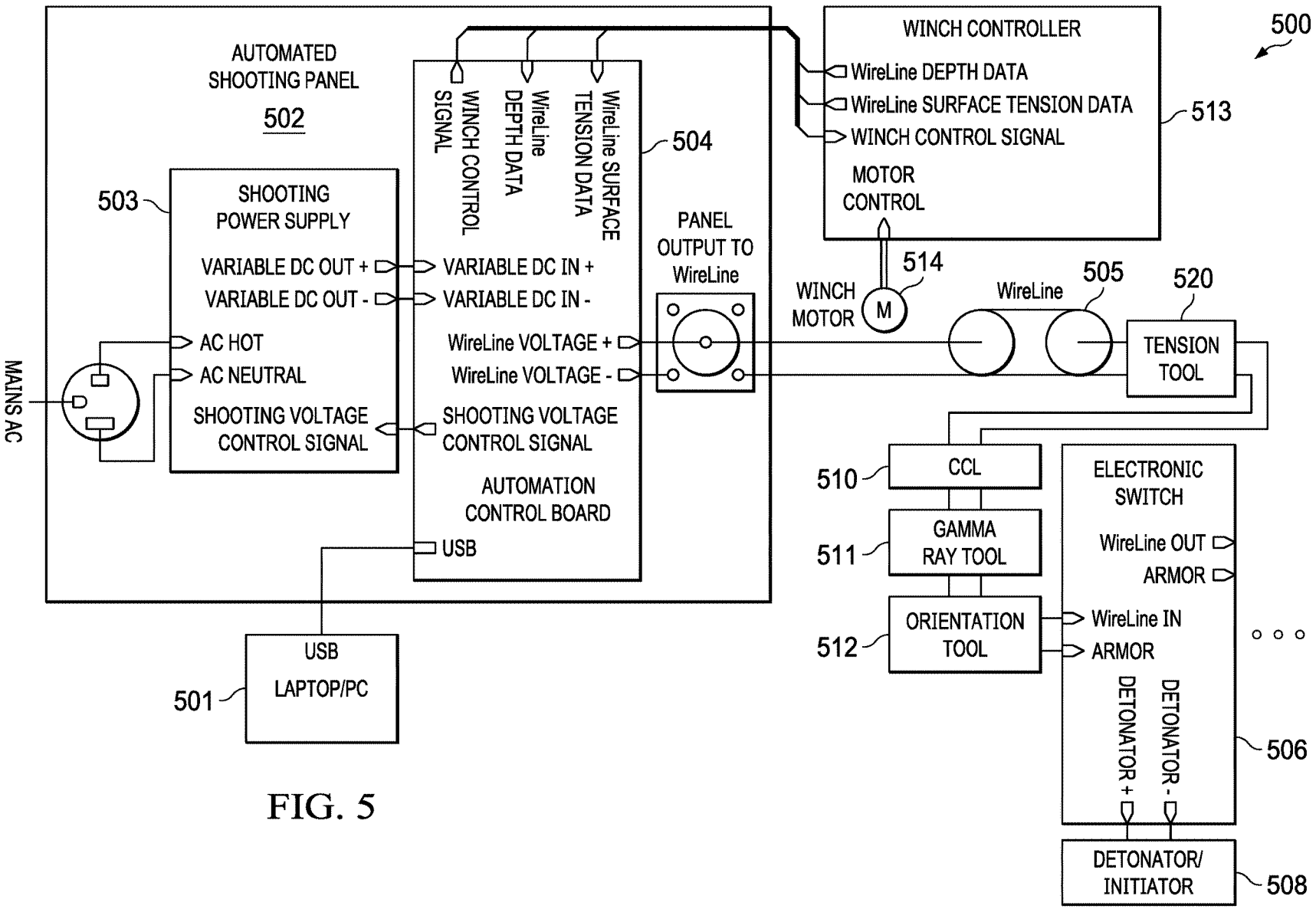
FIG. 5 shows a diagram representing a downhole perforating gun tool string with a casing collar locator, gamma ray tool, and orientation tool on a wireline electrically connected to an perforating unit, having a shooting panel, data acquisition system, and a winch controller.

An example embodiment is disclosed in FIG. 5 showing the perforating unit 500 having a perforating panel, data acquisition system, and winch controller. The perforating unit 500 includes a perforating panel 502 powered by AC mains. The AC mains power the shooting power supply 503 which is coupled to the control board 504 which performs data acquisition. Control board 504 is coupled to a computer 501, either via a USB connection or a wireless connection. Control board 504 is coupled to a panel output, which is coupled to the wireline 505. The wireline 505 is connected to a downhole tool that can include one or more of a downhole tension tool 520, casing collar locator (CCL) 510, a gamma ray tool 511, an orientation tool 512, and at least one electronic switch 506 which is connected to at least one detonator/initiator 508. The control board 504 is connected to winch controller 513 which controls winch motor 514. The winch controller 513 depends on wireline depth data, wireline surface tension data, and a winch control signal feedback when sending commands to the winch motor 514. The perforating unit 500 can detect the firing of the detonator/initiator 508 and automatically disconnect the firing voltage supplied by the shooting power supply 503, thus preventing a short circuit caused by wellbore fluids entering the downhole tool after detonation. The mitigation of a short circuit preserves the wireline 505 as well as other electronics coupled to the wireline.

Figure 6A:
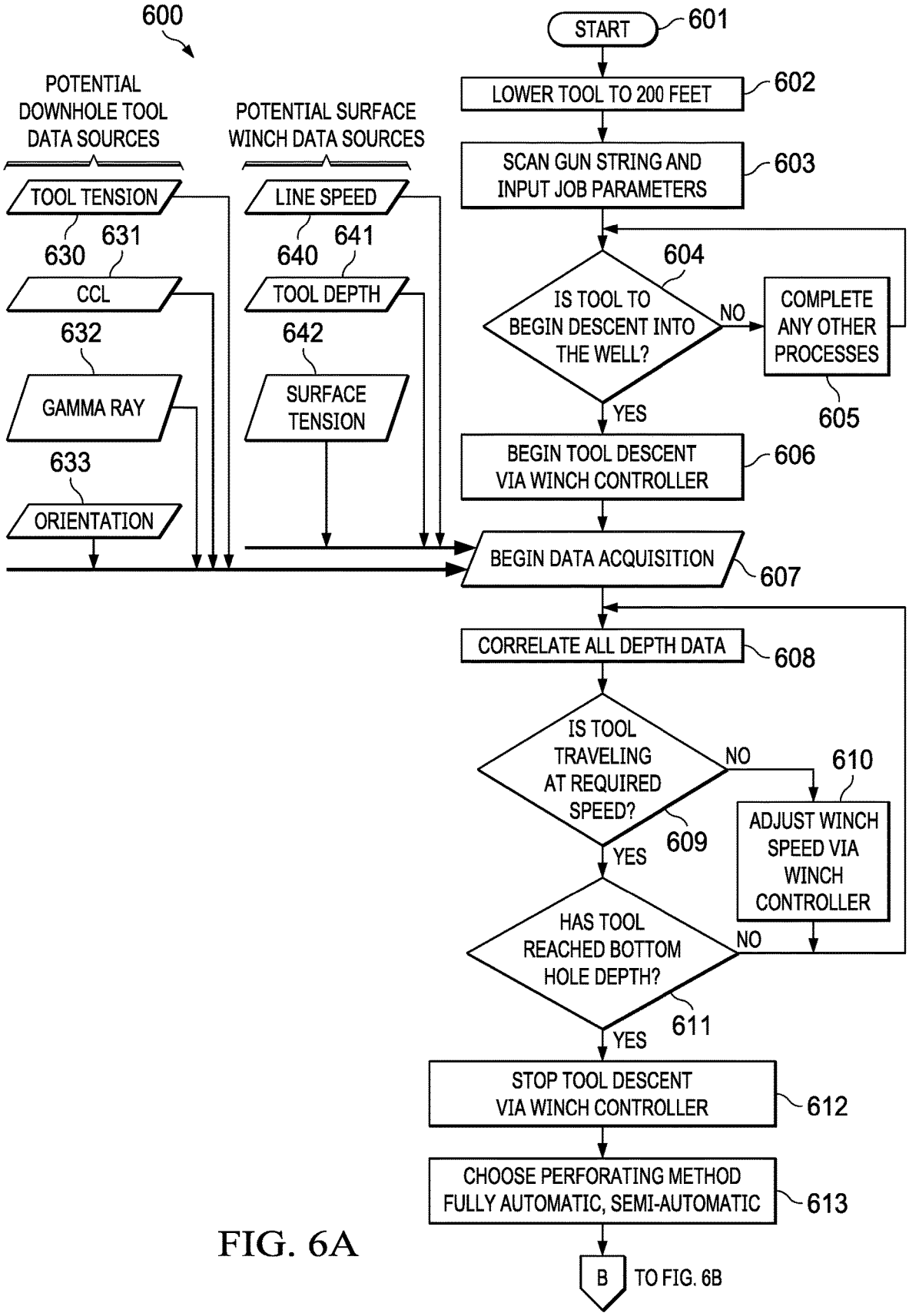
FIGS. 6A and 6B show a flow diagram of the operation of a perforating unit having an automated shooting panel, data acquistion system, and winch controller, interfacing with a downhole perforating gun string.

An example embodiment is disclosed in FIG. 6A showing the flowchart of the perforating unit 600 includes a perforating panel, data acquisition system, and winch controller. The program starts 601 and lowers the tool to 200 feet 602. The perforating unit 600 then scans the gun string and the user inputs the job parameters 603. The user then decides if the tool is to begin the descent into the well 604. If the tool is not ready for descent, then the user will complete any other processes 605 and then decide if the tool is to begin the descent into the well 604. If the tool is ready to descend then the perforating unit 600 descends the tool string via a winch controller 606.

The perforating unit 600 acquires data 607 from downhole tool data sources such as tool tension 630, the casing collar locator 631, the gamma ray tool 632, and the orientation sensor 633. The perforating unit 600 will acquire data 607 from surface winch data sources including tool depth 641 and surface tension 642. Line speed 640 is calculated by the data acquisition 607 based on data from the surface winch data sources. All depth data is correlated 608.

The speed of descent is queried 609 and if the descent is not at the required speed then the perforating unit 600 adjusts the winch speed 610. If the tool is descending at the required speed it will continue until it reaches the bottom hole depth 611. When the tool reaches the desired depth, the program stops the tool descent 612. The user then selects whether the perforating method is either fully automatic or semi-automatic, 613.

Figure 6B:
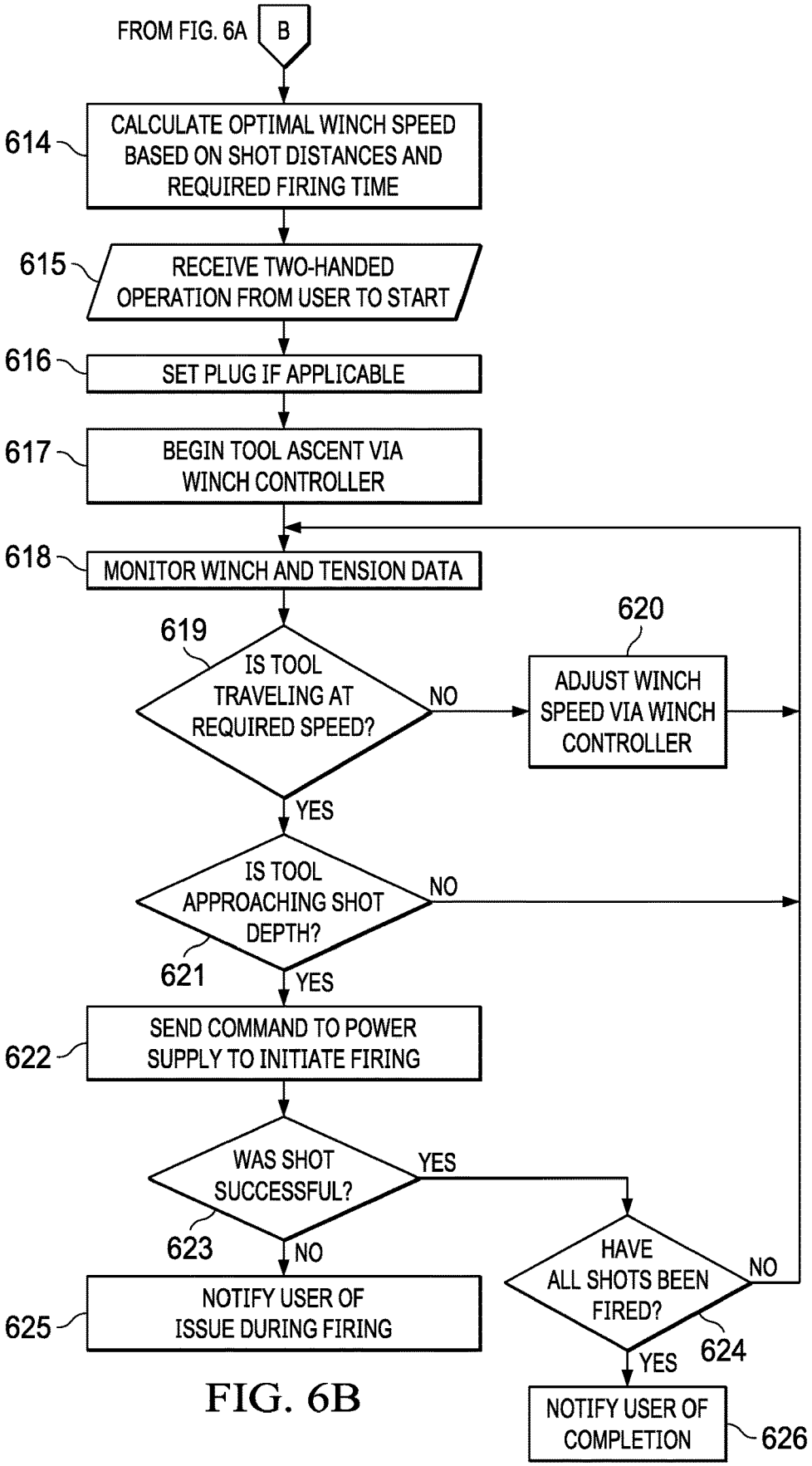

The program depiction continues in FIG. 6B. The program calculates the optimal winch speed based on shot distances and required firing time 614. The perforating unit 600 then receives the two-handed operation from the user to start 615. A plug is set if applicable 616. The tool ascends via winch controlled by winch controller 617. The program monitors the winch and tension data 618. The tool speed is evaluated 619 and adjusted as necessary 620. The program determines whether the tool is approaching the shot depth 621. When the program determines that the tool is approaching the shot depth 621 it sends a command to the power supply to initiate firing 622. The perforating unit 600 then determines whether the shot was successful 623. If it was not successful, then the user is notified of any issues 625. If it was successful, then the program determines if all shots have been fired 624. If all shots have been fired, then the program notifies the user of completion 626. If all shots have not been fired, then the program will revert to querying tool speed and depth to fire the next shots.

For horizontal wells, a manned pumping unit is required to pump fluids to push the perforating tools string through the lateral portion of the wellbore to the final desired measured depth. During the pump down process the user who is controlling the winch must also actively monitor and respond to the tension on the downhole tool string caused by the pump rate of the surface pumping unit. The user manning the pump controller must actively monitor and respond to the line speed and tool string tension during the pump down process.

An example embodiment of a perforating unit can automate and control the shooting power supply, data acquisition system, winch controller and pump controller during tool deployment into well, tool retrieval out of well, and the perforating processes. The Data Acquisition system of the perforating unit acquires, processes, interprets and logs one or more of the following data sets: Pump rate from the surface pumping unit, Depth data from the winch unit, line speed data from the winch unit, surface tension data from the winch unit, tension data from sensors on the downhole tool string, orientation sensor data from the downhole tool string, and depth correlation data from sensors in the downhole tool string such as Casing Collar Locator (CCL) or Gamma Ray (GR) detectors. One or more of the data sets is monitored by the perforating unit such that one or more of the pump controller, winch controller, shooting power supply and electronic switch software, automatically responds without any user input once automatic mode is activated on the perforating unit. The processes done by the user that can be automated to include: pump rate of the surface pumping unit, deployment and retrieval of the perforating tool string via the winch at depths below 200 ft., correlating depth acquisition to the electronic switch software and power supply panel, software input to check-arm-enable the electronic switch and applying the necessary voltage for the adequate amount of time to fire the initiator.

The perforating tool string is deployed into the well bore below a depth of 200 feet before the perforating unit is powered on. Prior to descent into the well or during the trip downhole below a depth of 200 feet, the user can select "Auto Mode" in the perforating unit then setup the automated process by entering the cable head weak point (max downhole tension), total depth, min and max line speed, min and max surface tension, number of electronic switches, each gun shot depth, depth correlation off set and each Stop depth. During descent into the lateral section of a horizontal well bore, which requires surface pumping to assist the tool string to total depth, the Data Acquisition portion of the perforating unit acquires and interprets data used for depth correlation, winch control and pump control. Line Depth, line speed and surface tension are gathered from the winch unit and displayed on the main perforating unit graphical user interface (GUI). Depth correlation data is acquired from sensors in the downhole tool string such as Casing Collar Locator (CCL) or Gamma Ray (GR) detectors then processed and displayed on the perforating unit GUI. Pump rate is acquired from the pump controller and displayed on the perforating unit GUI.

Once Auto Mode is started, the winch controller of the perforating unit monitors the depth, line speed, pump rate and tool tension data from the data acquisition system of the perforating unit to automatically adjust line speed of the winch system to maintain optimal tool tension and ideal pump rate. At the same time, the pump controller of the perforating unit monitors the depth, line speed, pump rate and tool tension data from the data acquisition system of the perforating unit to automatically adjust pump rate of the surface pumping unit to maintain optimal tool tension and ideal pump rate. Optimal tool tension is calculated by data acquisition based on pre pump down operation user input—downhole tool pressure rating, min and max line speed, min and max surface tension and cable head weak point rating. Ideal pump rate is input pre pump down operation into data acquisition by user at incremental depths based on known well deviation survey. Optimal Tool Tension and Ideal Pump Rate are automatically adjusted by Data Acquisition according to depth as the tool string is pumped into the horizontal well. At any point in time, the user can exit "Auto Mode" to manually control the winch system. When total depth is detected by the data acquisition system, the perforating unit will first stop the pumping unit then stop the winch such the down hole tool string stops at the total depth input during job setup.

For both vertical and horizontal well completions, the perforating process begins during ascent out of the well. Once at total depth the perforating unit winch control automatically retrieves the tool string up hole at the winch speed calculated by the perforating unit based on user inputs during job setup. The user will start the perforating system with a simple two-handed operation such as holding keyboard button while pressing a spring loaded button on the perforating unit. This starts the shooting power supply automation sequence. As the downhole tool string autonomously approaches each shot depth, the perforating unit will autonomously address the switch for each gun, arm and apply power to fire each gun in the pre-programmed sequence at the exact shot depth input during setup. The user does not have to "do" anything during the perforating process once started. As an alternative method, the user must take two actions within each shot depth window (+/−x feet within each shot depth) in order for the power supply to automatically output shooting power. The two-handed operation could be holding keyboard button while pressing a spring loaded button on the perforating unit. The perforating unit will also have standard manual mode capabilities. Should any issues arise, the system will alert the user to stop and revert to manual mode.

The perforating unit will monitor winch speed and surface and/or downhole tension to safely return the tool string to surface and stop at 200 feet. The perforating unit will revert to manual mode where the winch must be manually controlled until back at surface.

Figure 7:
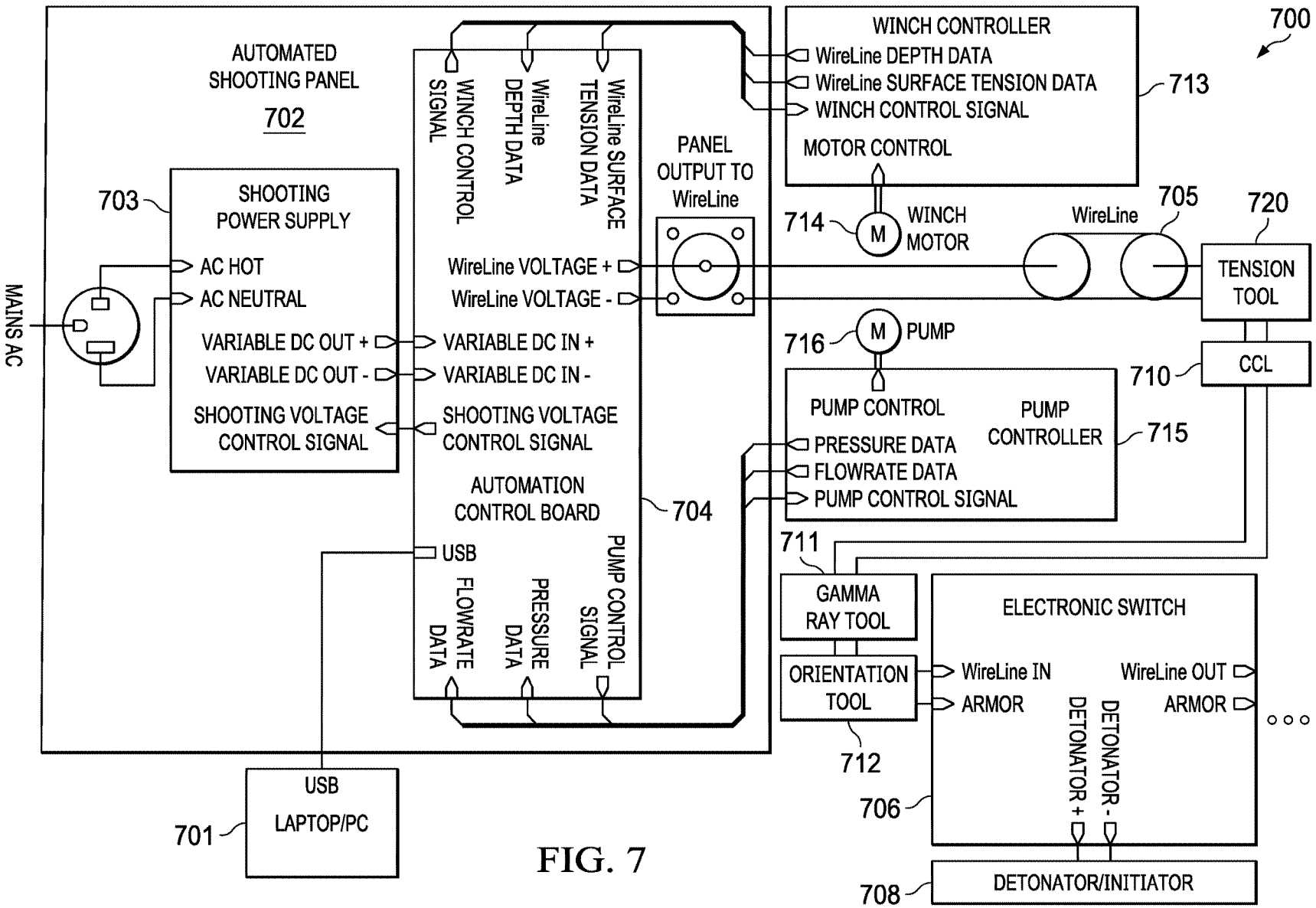
FIG. 7 shows a diagram representing a downhole perforating gun tool string with a casing collar locator, gamma ray tool, downhole tension tool, and orientation tool on a wireline electrically connected to a perforating unit having a perforating panel, data acquistion system, winch controller, and a pump controller.

An example embodiment is disclosed in FIG. 7 showing the perforating unit 700 includes a perforating panel, data acquisition system, winch controller and pump controller. The perforating unit 700 includes an automated shooting panel 702 powered by AC mains. The AC mains power the shooting power supply 703 which is coupled to the control board 704, which performs data acquisition. Control board 704 is coupled to a computer 701, either via a USB connection or a wireless connection. Control board 704 is coupled to a panel output, which is coupled to the wireline 705. The wireline 705 is connected to a downhole tool string that includes a downhole tension tool 720 and one or more of a casing collar locator (CCL) 710, a gamma ray tool 711, an orientation tool 712, and at least one electronic switch 706 which is connected to at least one detonator/initiator 708. The control board 704 is connected to winch controller 713 which controls winch motor 714. The winch controller 713 depends on wireline depth data, wireline surface tension data, and a winch control signal feedback when sending commands to the winch motor 714. The control board 704 is coupled to pump controller 715. Pump controller 715 uses a combination of pressure data, flowrate data, and a pump control signal feedback to control pump 716. The perforating unit 700 can detect the firing of the detonator/initiator 708 and automatically disconnect the firing voltage supplied by the shooting power supply 703, thus preventing a short circuit caused by wellbore fluids entering the downhole tool after detonation. The mitigation of a short circuit preserves the wireline 705 as well as other electronics coupled to the wireline.

Figure 8A:
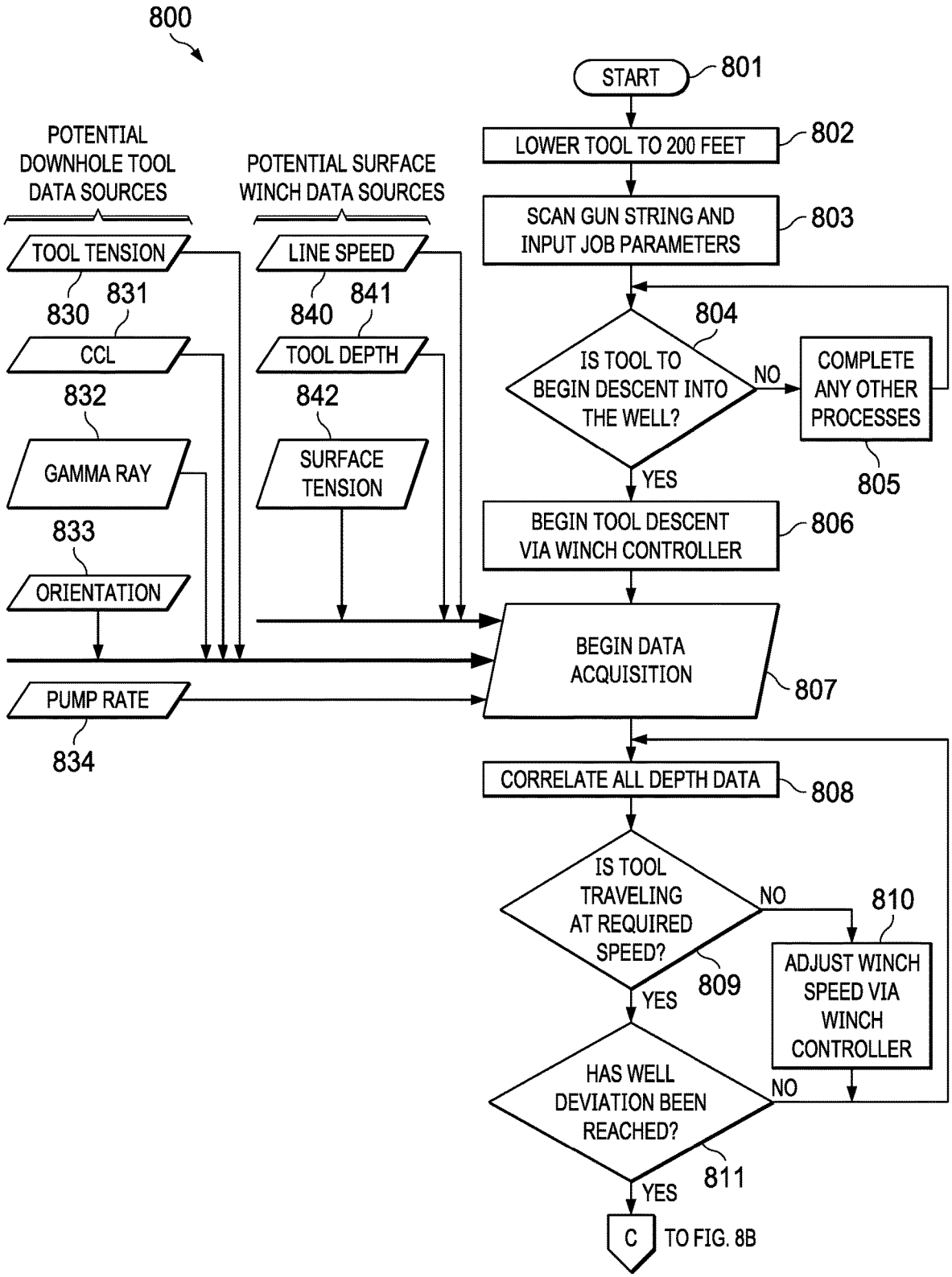
FIGS. 8A, 8B, and 8C show a flow diagram of the operation of a perforating unit having a perforating panel, data acquistion system, winch controller, and pump controller, interfacing with a downhole perforating gun string.

An example embodiment is disclosed in FIG. 8A showing the flowchart of the perforating unit 800. The program starts 801 and lowers the tool to 200 feet 802. The perforating unit 800 then scans the gun string and the user inputs the job parameters 803. The user then decides if the tool is to begin the descent into the well 804. If the tool is not ready for descent, then the user will complete any other processes 805 and then decide if the tool is to begin the descent into the well 804. If the tool is ready to descend then the perforating unit 800 descends the tool string via a winch controller 806.

The perforating unit 800 will acquire data 807 using downhole tool data sources such as tool tension 830, the casing collar locator 831, the gamma ray tool 832, and the orientation sensor 833. The perforating unit 800 will acquire data 807 using surface winch data including tool depth 841, and surface tension 842. The line speed 840 is calculated by the data acquisition 807 based on surface winch data sources. The perforating unit 800 will acquire data including pump rate 834. All depth data is correlated 808 to determine the location of the tool string and its downhole velocity.

The speed of descent is queried 809 and if the descent is not at the required speed then the perforating unit 800 adjusts the winch speed 810. If the tool is descending at the required speed it will continue until it has reaches the desired well deviation 811.

Figure 8B:
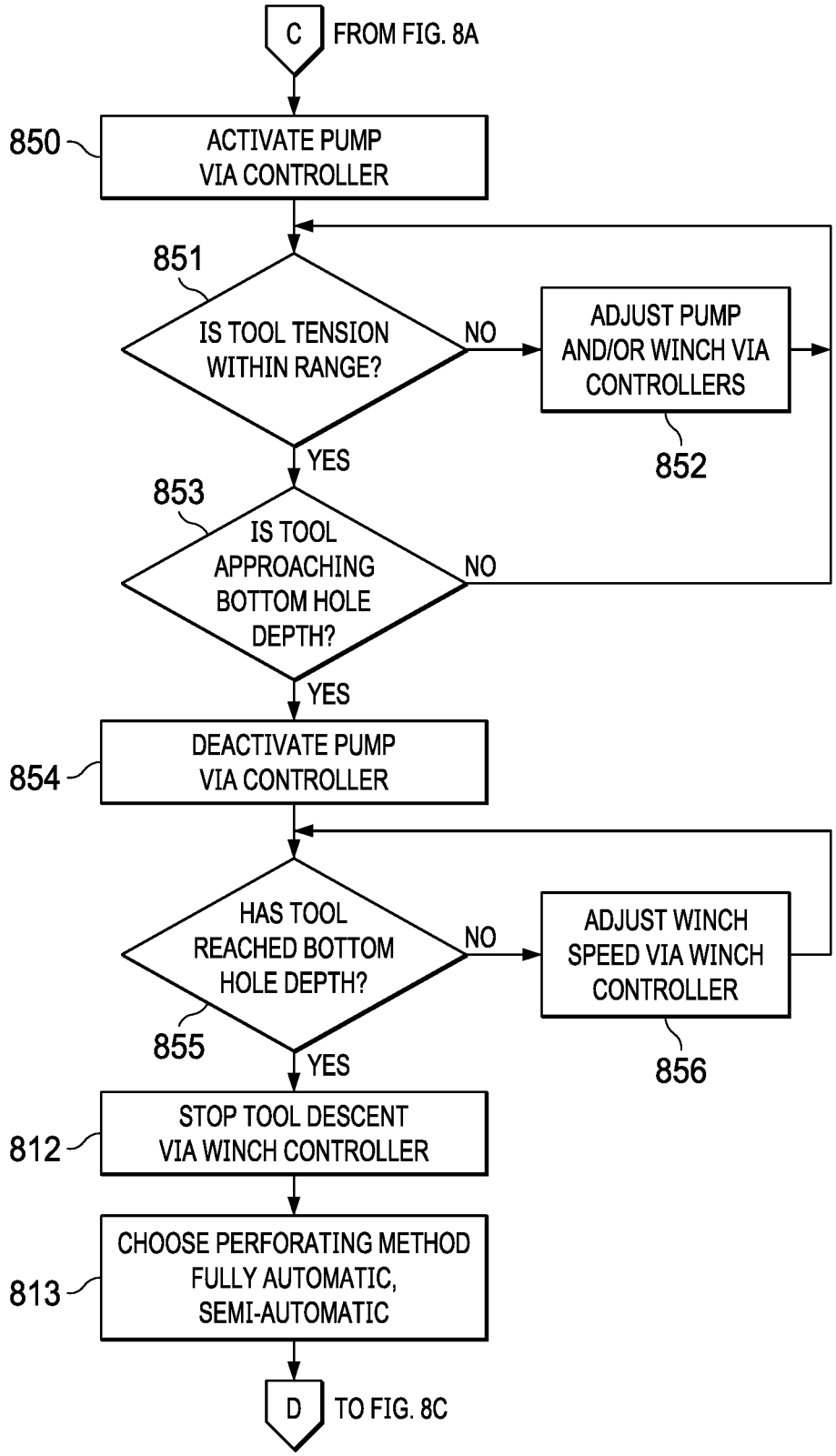

The program depiction continues in FIG. 8B. The perforating unit 800 activates the pump via the pump controller 850. The perforating unit 800 determines if the tool tension is within a desired range 851. If the tool tension is not within the desired range, then the perforating unit 800 will adjust the pump and/or winch via the appropriate winch controller or pump controller 852. The perforating unit 800 will then determine when the tool is approaching the bottom hole depth 853. Once the program determines the tool is approaching the bottom hole depth it deactivates the pump via the pump controller 854. The perforating unit 800 then determines if the tool has reached bottom hole depth 855. If not, then the panel will adjust the winch speed via winch controller to get the tool to the bottom hole depth 856.

When the tool reaches the bottom hole depth the perforating unit 800 stops the descent via the winch controller 812. The user then selects whether the perforating method is either fully automatic or semi-automatic, 813.

Figure 8C:
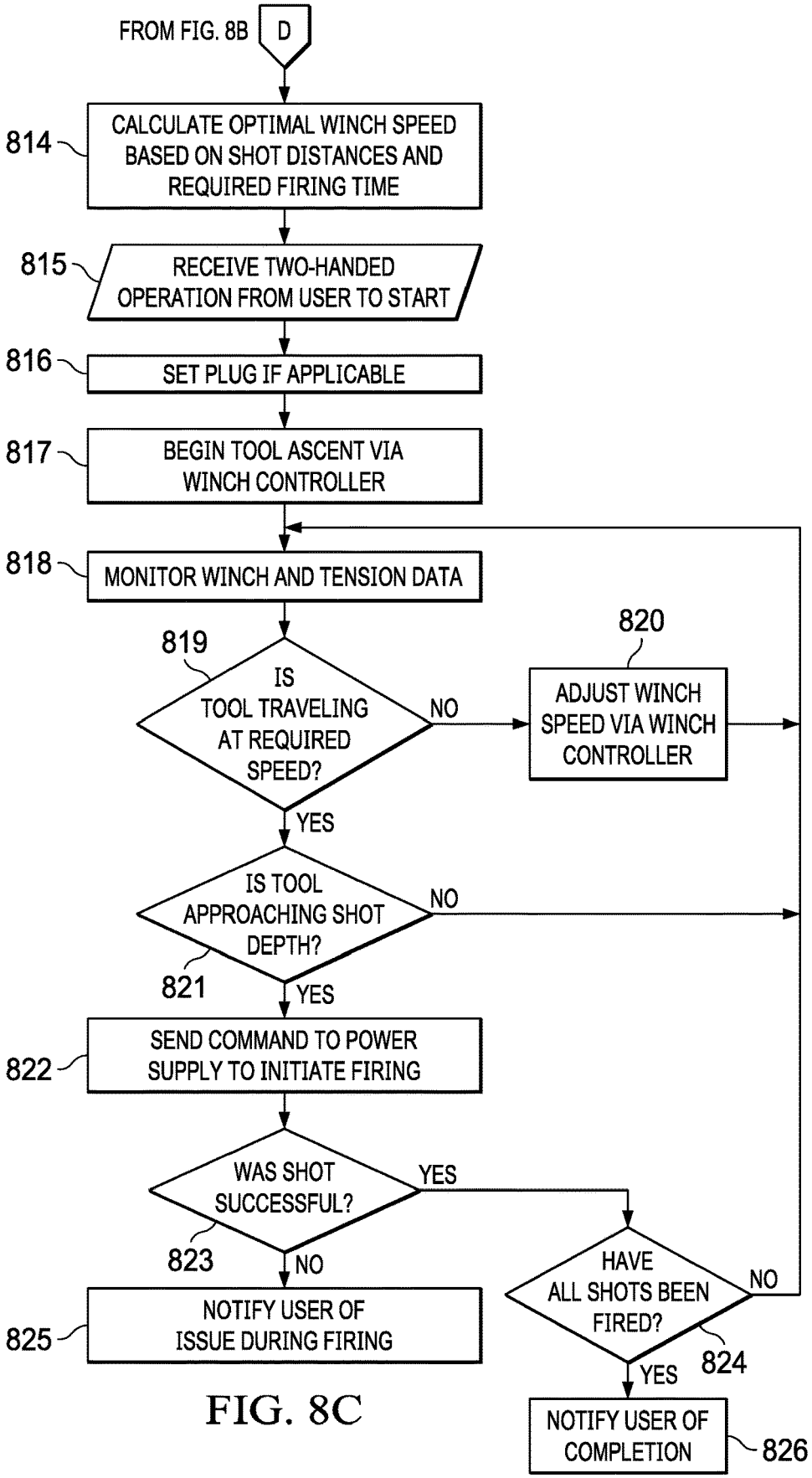

The program depiction continues in FIG. 8C. The program calculates the optimal winch speed based on shot distances and required firing time 814. The perforating unit 800 then receives the two-handed operation from the user to start 815. A plug is set if applicable 816. The tool ascends via winch controlled by winch controller 817. The program monitors the winch and tension data 818. The tool speed is evaluated 819 and adjusted as necessary 820. The program determines whether the tool is approaching the shot depth 821. When the program determines that the tool is approaching the shot depth 821 it sends a command to the power supply to initiate firing 822. The perforating unit 800 then determines whether the shot was successful 823. If it was not successful, then the user is notified of any issues 825. If it was successful, then the program determines if all shots have been fired 824. If all shots have been fired, then the program notifies the user of completion 826. If all shots have not been fired, then the program will revert to querying tool speed and depth to fire the next shots.

Although the invention has been described in terms of embodiments which are set forth in detail, it should be understood that this is by illustration only and that the invention is not necessarily limited thereto. For example, terms such as upper and lower or top and bottom can be substituted with uphole and downhole, respectfully. Top and bottom could be left and right, respectively. Uphole and downhole could be shown in figures as left and right, respectively, or top and bottom, respectively. Generally downhole tools initially enter the borehole in a vertical orientation, but since some boreholes end up horizontal, the orientation of the tool may change. In that case downhole, lower, or bottom is generally a component in the tool string that enters the borehole before a component referred to as uphole, upper, or top, relatively speaking. The first housing and second housing may be top housing and bottom housing, respectfully. In a gun string such as described herein, the first gun may be the uphole gun or the downhole gun, same for the second gun, and the uphole or downhole references can be swapped as they are merely used to describe the location relationship of the various components. Terms like wellbore, borehole, well, bore, oil well, and other alternatives may be used synonymously. Terms like tool string, tool, perforating gun string, gun string, or downhole tools, and other alternatives may be used synonymously. The alternative embodiments and operating techniques will become apparent to those of ordinary skill in the art in view of the present disclosure. Accordingly, modifications of the invention are contemplated which may be made without departing from the spirit of the claimed invention.

What is claimed:

1. A surface control system for controlling an initiator in a downhole perforating gun string comprising:

a perforating unit further comprising a software driven power supply, a control board coupled to the power supply, wherein the power supply is programmed to automatically output a specified amount of voltage/current, without user action, over a specified period within a specified depth window;

wherein the perforating unit deactivates the software driven power supply after an initiation is detected;

wherein the perforating unit automatically determines that the perforating gun string is approaching the shot depth and then commands the firing of at least one perforating gun using the software driven power supply based on acquired data including the depth, at least one active addressable switch in the toolstring, distance between predetermine shot locations, time to increase voltage for firing, and time required to communicate with each of the at least one addressable switch after firing the perforating gun string determines that the shot was fired; and a winch controller receiving depth data, wireline surface tension data, and a winch control feedback wherein the winch controller evaluates the perforating gun string ascent speed and then sends commands to the winch motor to achieve a calculated optimal winch speed required to perforate on programmed depth while retrieving the toolstring from bottom based on shot distances and required firing time, depth data from a winch, line speed data from the winch, and surface tension data from the winch; and wherein the perforating unit communicates with at the least one addressable switch.

2. The surface control system of claim 1, wherein the output voltage and duration is based on firing a detonator in a perforating gun.

3. The surface control system of claim 1, wherein the output voltage and duration is based on firing an igniter in a plug setting tool.

4. The surface control system of claim 1, wherein the perforating panel can detect when and at what depth the initiator is fired.

5. The surface control system of claim 1, wherein the perforating panel can detect when and at what depth the initiator is fired and automatically record and log the time at which the initiator firing event was detected.

6. The surface control system of claim 1, further comprising of a data acquisition system obtaining one or more surface data including surface wireline tension, line speed and calculated downhole tool depth based on line speed and time.

7. The surface control system of claim 1, further comprising a data acquisition system obtaining downhole tool data from a downhole casing collar locator for depth correlation.

8. The surface control system of claim 1, further comprising a data acquisition system obtaining downhole tool data from a downhole gamma ray tool for depth correlation.

9. The surface control system of claim 1, further comprising a winch controller that obtains the optimal winch speed to perforate on programmed depth when automatically retrieving the toolstring from the bottom of the well.

10. A method for detonating a downhole tool comprising:

lowering the tool into a wellbore a first predetermined distance;

acquiring surface wireline tension data, winch speed data, and downhole tool data;

calculating the optimal surface wireline tension based on pre-pump down operation user input of minimum winch speed, maximum winch speed, minimum surface tension, maximum surface tension, and cable head weak point rating;

calculating ideal pump rate for automatically adjusting at incremental tool depths based on data from well deviations from a known wellbore deviation survey input prior to the pump down operation;

scanning a gun string;

inputting job parameters into a perforating unit;

descending the tool to a second predetermined wellbore depth;

activating a pump at a first predetermined wellbore depth;

automatically adjusting winch speed and pump rate based on ideal surface wireline tension and ideal pump rate;

deactivating the pump at the second predetermined wellbore depth;

stopping the tool at the second predetermined wellbore depth;

ascending the tool to a first predetermined shot depth;

monitoring depth, at least one active addressable switch in the toolstring, distance between predetermine shot locations, time required to communicate with each of the at least one addressable switches;

calculating an optimal winch speed required to perforate on programmed depth while retrieving the toolstring from bottom based on shot distances and required firing time, and communicating with the at least one active addressable switch;

evaluating the toolstring speed by measuring the line speed, tool depth, surface tension, and winch control feedback;

automatically adjusting the line speed of the winch system to maintain the evaluated toolstring speed at the calculated optimal winch speed;

automatically firing the tool at the first predetermined shot depth, wherein the perforating unit sends a command to a shooting power supply to initiate the tool based on acquired data including the depth, the at least one active addressable switch in the toolstring, distance between predetermine shot locations, the time required to increase the voltage for firing, and the time required to communicate with each of the at least one addressable switch, without any physical action to the perforating unit required by the user when at the predetermined shot depth;

determining if the firing at the first predetermined shot depth was successful;

continuing the toolstring ascent to the next predetermined shot depth;

preventing a short circuit after firing the shot at the first predetermined shot depth by deactivating the shooting power supply;

determining if all shots have been fired; and notifying user whether or not all shots have been fired.

11. The method of claim 10 further comprising detecting the firing of the initiator and automatically recording and logging the time of the firing event.

12. The method of claim 10 further comprising retrieving the toolstring automatically from the bottom during the perforating process.

13. The method of claim 10 further comprising determining if the tool is ready for descent.

14. The method of claim 10 wherein downhole tool data includes data from a casing collar locator.

15. The method of claim 10 wherein downhole tool data includes data from a gamma ray tool.

16. The method of claim 10 further comprising correlating downhole tool data and surface wireline data to determine the location of the tool string and line speed.

17. The method of claim 10 wherein the second predetermined depth is the bottom hole depth.

18. The method of claim 10 further comprising setting a plug.

19. The method of claim 10 further comprising a calculating the optimal winch speed to perforate on programmed depth when automatically retrieving the toolstring from the bottom of the well.

* * * * *